US006035462A

United States Patent [19]

Bennett et al.

[11] Patent Number: 6,035,462

[45] **Date of Patent: *Mar. 14, 2000**

[54] PORTABLE COMMODE SEAT WITH LIFT ASSIST

[75] Inventors: John Bennett, Rancho Palos Verdes; Willis C. Bradley, Gardena, both of Calif.

[73] Assignee: Lenjoy Engineering, Inc., Gardena, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/959,670

[22] Filed: Oct. 29, 1997

[51] Int. Cl.[7] ..... A47K 13/10

[52] U.S. Cl. ..... 4/667; 4/254

[58] Field of Search ..... 4/254, 480, 667; 297/DIG. 10, 313

[56] References Cited

U.S. PATENT DOCUMENTS

| | | | |
|---|---|---|---|
| 3,473,174 | 10/1969 | Cool | 4/254 X |
| 4,034,426 | 7/1977 | Hardwick et al. | 4/667 X |
| 4,690,457 | 9/1987 | Poney et al. | 297/DIG. 10 X |
| 4,884,841 | 12/1989 | Holley | 4/254 X |
| 5,155,873 | 10/1992 | Bridges | 4/667 |
| 5,316,370 | 5/1994 | Newman | 297/313 |
| 5,561,872 | 10/1996 | Phillips | 4/667 |
| 5,661,858 | 9/1997 | House et al. | 4/667 |

*Primary Examiner*—Charles E. Phillips

*Attorney, Agent, or Firm*—Natan Epstein Beehler & Pavitt

[57] ABSTRACT

A portable commode with spring assisted lifting seat has a lightweight self-supporting stand, a seat hinged to the frame and a pair of pneumatic springs for lifting the seat to an elevated position. The springs yield under the body weight of the user to depress the seat to a lowered position. The springs can be easily set at different positions on the seat to adjust for users of different body weights. A removable waste receptacle on the frame permits the commode to be used by itself, as at a bedside location, or over a conventional toilet bowl installation.

6 Claims, 2 Drawing Sheets

PORTABLE COMMODE SEAT WITH LIFT ASSIST

BACKGROUND OF THE INVENTION

1. Field of the Invention

This invention relates generally to the field of health care aids for the infirm and more particularly is directed to a portable commode, for use with either an on-board waste receptacle as a self contained portable toilet, or in conjunction with a conventional toilet fixture, and featuring a lift assist seat for helping an infirm user rise to a standing position from the seat.

2. State of the Prior Art

Infirm persons who as a result of illness or advance age lack the physical strength to rise unaided from a sitting position have difficulty using conventional toilet fixtures. Various devices have been developed with the aim of assisting the infirm in the independent use of the toilet. In particular, toilet seats capable of lifting or supporting part or all of the user's body weight between a seated and a semi-standing position have been devised with the aim of helping the user through this physically demanding transition. For example, toilet seats equipped with a water powered or electrically powered seat lift mechanism are available. Also, one of the present coinventors coinvented a lift seat disclosed in U.S. Pat. No. 5,178,025 issued to Bennett et al. That device can be placed on an existing seat surface and has a low profile spring actuated mechanism which operates to lift the rear of the seat in upwardly to forwardly tilted position in order to partially carry the weight of the user and reduce the effort required by the user in lifting himself or herself up from the seat. That mechanism, however, is unsuited for use with a toilet seat because the lift assist mechanism is contained directly underneath the seat.

With the general tendency towards home health care, away from costly hospital facilities, there is a need for simpler, lighter and easier to use commode seats with lift assist capability, suitable for use both over the bowl of an existing toilet fixture, or with an on-board waste receptacle away from conventional bathroom facilities.

SUMMARY OF THE INVENTION

This invention addresses the aforementioned need by providing a portable commode with a lift assist seat for the infirm comprising a floor stand adapted to span the bowl of a conventional toilet fixture, a seat having a front hinged to said floor stand, and one or more springs connected between the floor stand and the seat for urging a rear of the seat from a depressed to a forwardly tilted position on the stand thereby to assist an infirm user from a seating position on the seat to a standing position. The preferred springs are gas or pneumatic springs, one spring on each side of the floor stand mounted in compression between the floor stand and the seat assembly. Significantly, the springs are mounted and arranged laterally offset from the central opening in the seat of the portable commode. This invention is not limited to any one type of spring and other types of springs such as hydraulic or mechanical springs may be substituted.

The protable commode also has means for selectively reconnecting the one or more springs between the stand and the seat for adjusting the effective spring force acting on the seat to suit a particular user's body weight. The means for reconnecting may include a series of attachment points for one end of each of the one or more springs, such that the effective spring force acting on the seat is adjusted by connecting the one end of the spring to a selected one of the attachment points.

More specifically, the adjustment of the spring force acting on the commode seat is effected by changing the distance between the hinge line of the seat and the point of application of the spring force to the seat.

By diminishing this distance, the effective mechanical advantage of the spring force on the seat is diminished, resulting in a reduced effective spring force on the seat for a lighter user body weight, or for a user requiring lesser assistance from the commode seat. Conversely, greater lifting force is obtained by increasing the distance between the attachment point of the spring to the seat and the hinge line of the seat, for heavier users or those requiring greater lifting aid.

DETAILED DESCRIPTION OF THE PREFERRED EMBODIMENTS

Figure 1:
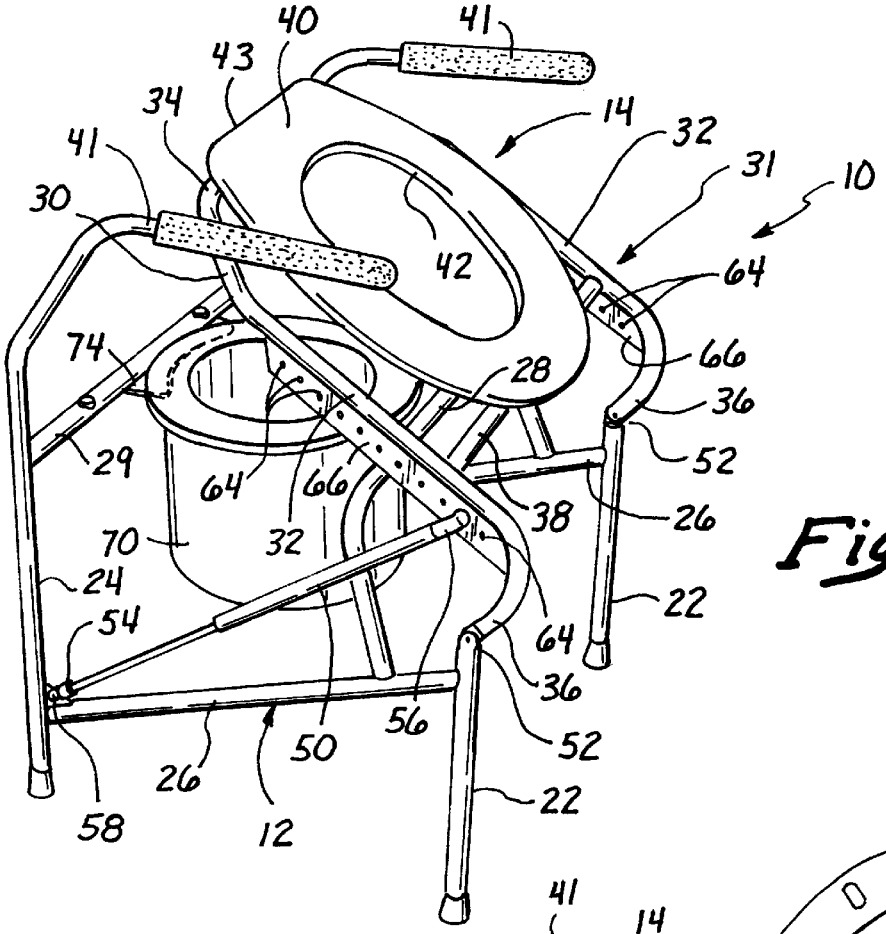
FIG. 1 is a perspective view of the novel portable commode with lift assist seat, shown configured with on-board waste receptacle.

With reference to the accompanying drawings in which like numerals indicate like elements, FIG. 1 shows a portable commode with lift assist seat which is generally indicated by the numeral 10. The portable commode 10 of FIG. 1 generally has a floor stand 12 which as shown in the drawings is self-supporting and free standing on four legs, and a seat assembly 14. The floor stand 12 further has four upright legs including two front legs 22 and two rear legs 24. A side brace 26 connects each front leg to a corresponding rear leg, a first cross-brace 28 interconnects the side braces, and a second cross brace 29 connects the rear legs to each other, giving structural rigidity to the floor stand. The stand has two opposite sides, each side made up of a front leg, a rear leg and a side brace. The legs and braces are preferably made of lightweight aluminum tubing in order to maintain a low overall weight of the commode 10.

Seat assembly 14 includes a seat frame 31 having a generally U-shaped element 30 which has two side portions 32 connected by a rear cross-portion 34, and two front ends 36. The side portions 32 are also connected by a front cross-brace 38. The seat assembly also includes a generally annular seat 40 having a central opening 42. The seat 40 is securely mounted on the seat frame 31 between the rear cross-portion 34 and the front cross-brace 38 by suitable fasteners, not shown in the Figure. The rear legs 24 extend upwardly above the seat 40 and are bent to a generally horizontal position to define an armrest 41 on each side of the seat, which may be grasped by an infirm user for support and balance while lowering himself or herself onto the seat 40 or while rising therefrom. The rear legs 24 and arm rests 41 are defined by a continuous length of tubing, and each arm rest is a generally horizontal portion of the continuous length, terminating in a free end 43. In the depicted embodiment of the invention, the arm rests 41 are consequently supported only on the rear legs 24.

Figure 5:
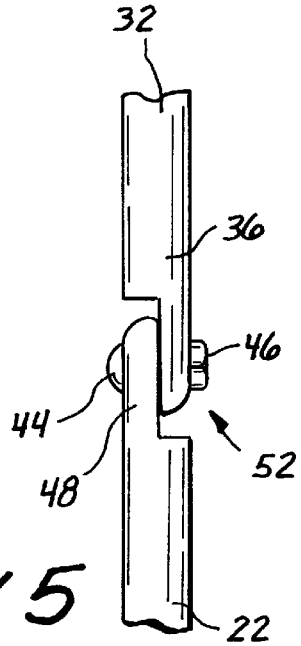
FIG. 5 is a detail front view of the hinge connection between the seat frame and the front legs, taken along line 5—5 in FIG. 3.

Each front end 36 of the seat frame is connected by a bolt 44 and nut 46, as shown in FIG. 5, to the top end 48 of a corresponding front leg 22 to form two hinges 52 connecting the seat assembly to the floor stand. The rear cross-brace of the seat assembly is supported on the second cross-brace of the floor stand in a lowered or depressed condition of the seat assembly illustrated in FIG. 3, such that the body weight of a person seated on seat 40 in this condition is carried by the four legs of the floor stand.

Figure 6:
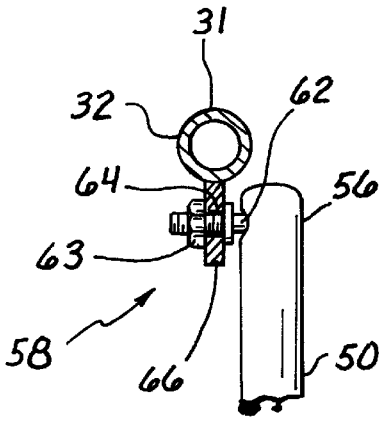
FIG. 6 is a detail view, partly in cross-section taken along line 6—6 in FIG. 4, of the releasable connection between the upper end of the pneumatic spring and one of the series of attachment holes provided along the seat frame.

The commode 10 has a pair of pneumatic springs 50 each of which has a lower end 54 and an upper end 56. As shown in the drawings, the preferred pneumatic springs 50 are self-contained and are not connected to any external source of power. Each lower end is pivotably connected to the floor stand 12, specifically, at the junction of the side brace 26 and the rear leg 24. The upper end of each spring is connected to the seat frame 31 by means of a pivot assembly 58 depicted in detail in FIG. 6. The pivot assembly 58 has a pivot bolt 62 extending transversely to the longitudinal dimension of the spring 50 and passing through an attachment hole 64 in a plate 66 which is affixed as by welding along the underside of each side portion 32 of the seat frame 31. A nut 63 threaded on the bolt 62 secures the pivot connection. The two springs 50 are selected so that in a fully extended condition of the two springs the seat assembly is lifted to a forwardly tilted position illustrated in FIGS. 1, 2 and 4, with the rear 43 of the seat 40 elevated at approximately a 45 degree angle relative to its aforementioned depressed, generally horizontal position of FIG. 3.

Figure 3:
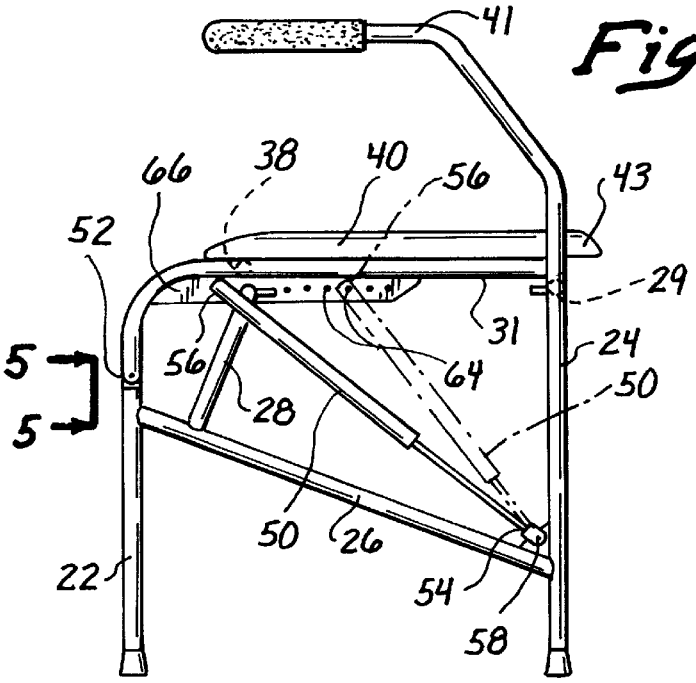
FIG. 3 is a left side elevational view of the commode configured as in FIG. 2, shown with the seat in depressed position.
Figure 4:
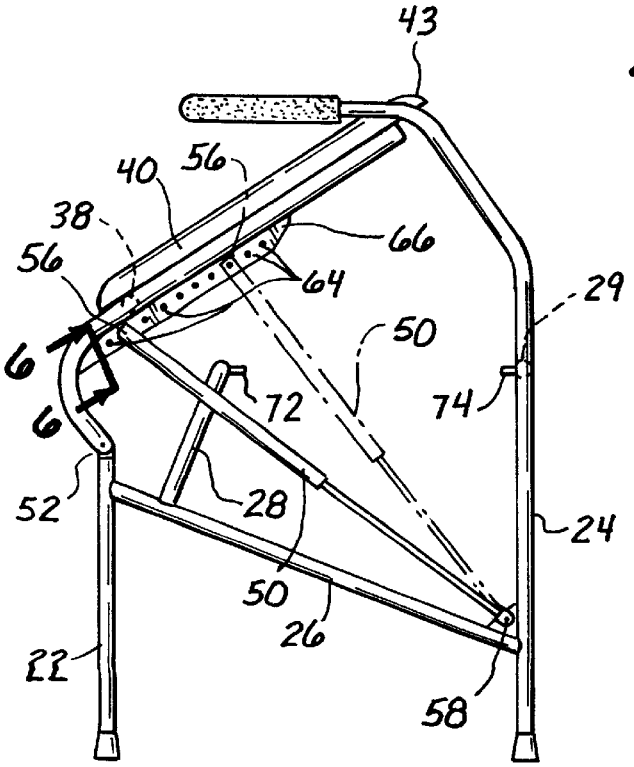
FIG. 4 is a view as in FIG. 3 showing the seat in forwardly tilted elevated position.

The plate 66 is perforated with a series of such attachment holes 64 evenly spaced apart in a direction generally towards and away from the hinge line defined by hinges 52. That is, the attachment holes 64 lie along a line which is transverse and approximately radial to that hinge line. Each hole 64 defines an attachment point for the upper end of the corresponding spring SO. In effect, the different attachment points provide a range of leverage factors by which the force of the springs 50 acting on the seat assembly 14 can be selectively modified. The effective spring force is the actual expansion force of the springs 50 compressed between the floor stand 12 and the seat assembly 14, adjusted for the leverage effect of the selected attachment point along the plates 66. In general, the effective spring force acting to lift the seat 40 increases as the attachment point is displaced away from the hinges 52 towards the rear of the seat, and conversely is at its minimum when the upper ends of the springs 50 are connected at the holes 64 closest to the hinges. As shown in FIGS. 3 and 4, the attachment points are sufficiently spaced away from the hinge connection 52 of the stationary lower portion of the tubular frame with the seat frame 14 so that when installed at the attachment point nearest to the hinge the pneumatic springs 50 will provide the aforementioned effective spring force is obtained at any of the attachment points 64 of the springs 50. Furthermore, it will be seen from FIGS. 3 and 4 that the angle of the spring 50 remains approximately the same during the lifting of the seat assembly 14 from the generally horizontal position of FIG. 3 to the elevated position in FIG. 4.

The springs 50 are selected to provide an effective spring force normally urging the seat assembly upwardly towards its elevated, tilted position with sufficient spring force to support and carry a significant portion of the body weight of an intended infirm user of the commode 10. The effective lifting force of the seat 40 can therefore be adjusted by repositioning the attachment point of the springs between the floor stand and the seat assembly, to suit the needs of a particular user. A greater or lesser degree of lift assist to the user can be provided by appropriate adjustment of the spring connections. It will be appreciated that an equivalent range of leverage factors can be achieved by providing a series of attachment points for the lower ends 54 of the springs 50 while providing a single pivotable attachment point for the upper ends 56.

The commode of FIG. 1 is configured as a self-contained portable toilet by providing an on-board waste receptacle 70 supported under the central seat opening 42 between the first and second cross-braces of the floor stand on mounting flanges 72, 74 which are best seen in FIG. 4. The receptacle 70 is removable from the commode for waste disposal and cleaning. It will be appreciated that the waste of receptacle 70 is supported on the stationary portion of the floor stand, and does not lift with the seat assembly 14. In this configuration the commode is suited for use where a nearby bathroom is not available or the condition of the user is such that a toilet closely adjacent to a bed is needed.

Figure 2:
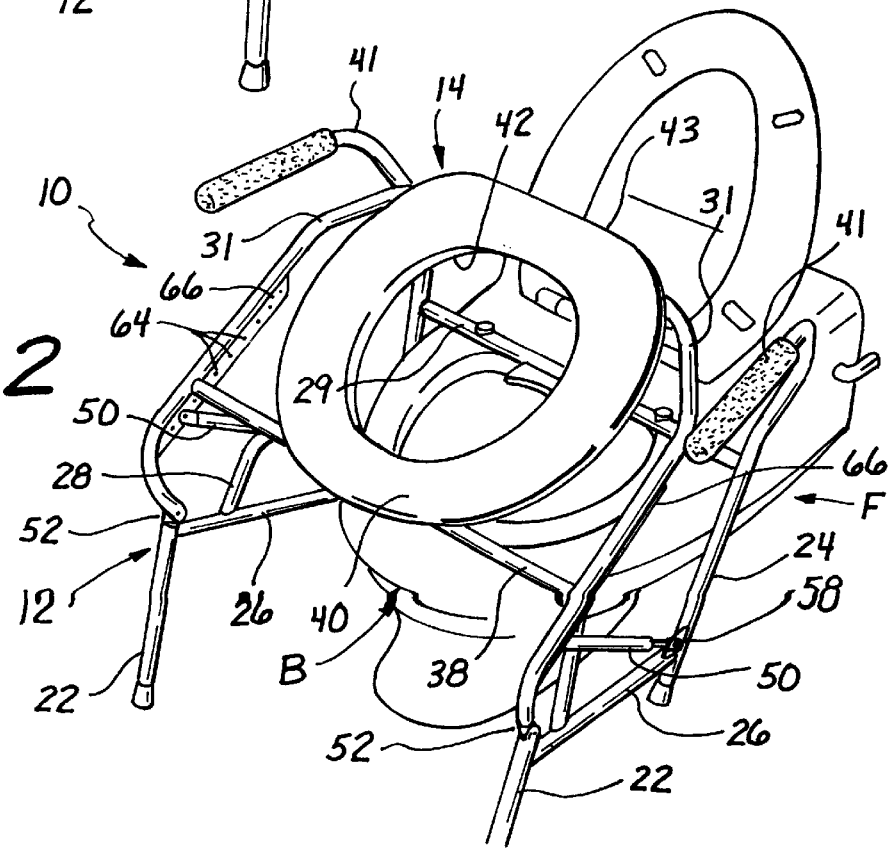
FIG. 2 is a perspective view of the portable commode of FIG. 1 shown without the on-board waste receptacle and installed over the bowl of a conventional toilet fixture.

Removal of the waste receptacle 70 configures the commode 10 for use with a conventional toilet fixture in an existing bathroom. The width of the commode measured between the opposite sides and the height of at least the second cross-brace 29, and preferably both first and second cross-braces 28, 29, are such as to span the bowl B of a conventional toilet fixture F as illustrated in FIG. 2. The rear legs 24 are spaced apart to admit the width of the bowl B while the height of the second cross-brace 29 admits the height of the same bowl into position between the opposite sides of the floor stand and under the central opening 42 of the seat 40, as illustrated in FIG. 2.

Springs other than pneumatic springs can be used with the commode 10, including mechanical springs such as coil springs, or hydraulic springs. It must be understood that these and other changes, modifications and substitutions to the preferred embodiment, which has been described and illustrated for purposes of clarity and example, will be apparent to those having ordinary skill in the art without thereby departing from the scope and spirit of the present invention, which is defined by the following claims.

What is claimed as novel is:

1. A portable commode with lift assist seat comprising:

a stand having two front legs and two rear legs, side braces connecting said front legs with said rear legs, a first cross member between said side braces, and a second cross member between said rear legs; a seat assembly hinge connected to an upper end of each of said front legs, said seat frame having a generally U-shaped member including side portions joined by a rear cross-portion, said side portions having forward ends hingedly connected to said upper ends of said front legs, and a third cross-member between said side portions, said seat being supported between said rear cross-portion and said third cross-member, said rear cross-portion being supported on said second cross-member of said stand in said depressed condition of said seat assembly; and pneumatic springs connected between said stand and opposite sides of said seat assembly for lifting said seat assembly in an unloaded condition to a forwardly tilted position, said springs being selected such that said seat assembly is depressed to a lowered position under the body weight of a user on said seat assembly, said seat assembly comprising a seat frame and a seat on said frame, and perforated side plates secured to said seat frame defining a series of holes along each of two opposite sides of said seat assembly, said pneumatic springs each having a lower end connected to said stand and an upper end connected to said seat assembly at a selectable one of said series of holes to permit adjustment of the effective lifting force of said springs acting on said seat assembly to a range of body weights.

2. The portable commode of claim 1 wherein said side plates are secured to said side portions of the seat frame.

3. The portable commode of claim 1 wherein said lower ends of said pneumatic springs are connected to said stand in the vicinity of a joint between each of said rear legs and a corresponding one of said side braces.

4. The portable commode of claim 1 wherein said rear legs and said second cross-member are arranged, configured and dimensioned for admitting a conventional toilet bowl under said seat assembly.

5. A portable commode with lift assist seat comprising:

a stand having two front legs and two rear legs, side braces connecting said front legs with said rear legs, a first cross member between said side braces, and a second cross member between said rear legs; a seat assembly including a seat defining an opening and being hingedly connected to an upper end of each of said front legs; a waste receptacle removably attached to said first and second cross members, and pneumatic springs connected between said stand and opposite sides of said seat assembly for lifting said seat assembly in an unloaded condition to a forwardly tilted position, said springs being selected such that said seat assembly is depressed to a lowered position under the body weight of a user on said seat assembly, wherein said rear legs have upper portions bent to a generally horizontal position for providing arm rests on opposite sides of said seat assembly, said arm rests being supported only on said rear legs, and wherein said rear legs and said arm rests are each defined by a continuous length of tubing and each arm rest is a generally horizontal portion of said continuous length terminating in a free end.

6. A portable commode with lift assist seat comprising:

a stationary lightweight tubular frame free standing and self-supporting on a floor surface, a seat assembly including a lightweight tubular seat frame hinged to the stationary frame and a seat defining a central opening, and a pair of self-contained pneumatic springs on opposite sides of said floor stand connected between the stationary frame and said seat frame, said stationary frame being arranged, configured and dimensioned for admitting the bowl of a conventional commode fixture under said seat assembly and between said sides, and a waste receptacle removably secured to said stationary frame under said central opening, each of said springs connected in compression between the stationary frame and said seat frame for lifting a rear of said seat assembly in an unloaded condition to a forwardly tilted position, said springs yielding under the body weight of a person on said seat such that said seat assembly is depressed to a generally horizontal position on the stationary frame, the effective force of said springs acting to lift said seat assembly being adjustable to a range of body weights by reconnecting each of the pneumatic springs at selected ones of a series of attachment points provided on each side of the stationary frame; the entire portable commode characterized in that it is free standing and sufficiently lightweight to be movable with little physical effort between a bedside location and a bathroom toilet facility and otherwise placed where needed by a debilitated user, and wherein said waste receptacle remains stationary with said stationary frame during lifting of said seat assembly.

* * * * *